US005685747A

United States Patent [19]

Rodriguez

[11] Patent Number: 5,685,747

[45] Date of Patent: Nov. 11, 1997

[54] PERFECTED TERMINAL

[76] Inventor: Eduardo Rodriguez, Passeig De L'Estacio 14, Valls, Tarragona 43800, Spain

[21] Appl. No.: 503,600

[22] Filed: Jun. 9, 1995

[30] Foreign Application Priority Data

Feb. 21, 1995 [ES] Spain ..... 9500470 U

[51] Int. Cl.[6] ..... H01R 11/22

[52] U.S. Cl. ..... 439/852; 439/856

[58] Field of Search ..... 439/842, 843, 439/851–856, 861, 862

[56] References Cited

U.S. PATENT DOCUMENTS 4,453,799 6/1984 Inoue et al. ..... 439/861

4,798,545 1/1989 Roy et al. ..... 439/856

4,919,628 4/1990 Mobley et al. ..... 439/852

4,950,183 8/1990 Watanabe et al. ..... 439/852

5,281,175 1/1994 Chupak et al. ..... 439/852

*Primary Examiner*—J. J. Swann

*Attorney, Agent, or Firm*—Dowell & Dowell

[57] ABSTRACT

An electrical terminal connector including spaced side walls which are bent to form a pair of opposing electrical contacts which extend within a housing defined partially by the side walls and wherein stops are provided between the contacts and the side walls for purposes of facilitating electrical contact with a male terminal inserted therebetween.

8 Claims, 1 Drawing Sheet

PERFECTED TERMINAL

BACKGROUND OF THE INVENTION

1. Field of the Invention

The present application consists, as indicated by its title, of a terminal whose new characteristics of manufacture, structure and design, fulfil the mission for which it has been specifically conceived with the maximum of effectiveness and security.

The invention belongs to the technical sector of electrical components specially designed to work in combination with electric conductors and wiring, with the said terminals being placed at the ends of an electrical conductor prepared to facilitate its connection to a device or to a male or female terminal.

More specifically, the invention includes a clip system, i.e. a configuration in the form of a clamp to attach by pressure electrical conductor terminals, as per the inclined drawings depicting the corresponding male terminal.

2. History of the Related Art

Terminals like those that will be described later are used in connector boxes used for simultaneous connections in the automobile industry. The suitability of a terminal is based primarily on the pressure and perfection of electrical contact between the surfaces of the terminals to be connected. It is important that the force exerted between the male and female terminals at no point exceeds values of, for instance, 3 newton, since it is quite normal that a connector box may contain over 20 connectors, whereupon the force needed to insert the male terminals inside the female terminal is of a considerable magnitude, as is that of the contact parts which facilitate the entry of the male terminals.

SUMMARY OF THE INVENTION

The terminal which is the object of the present Specification has a completely conventional anterior section, which is built upon a considerably flat base with wings and ribbed tabs which protrude perpendicularly from the base of the terminal and whose purpose is to trap between their inner surfaces the end of the electrical conductor, once its isolating sheath is removed, thus establishing electrical contact therewith.

The rear portion of the terminal presents a series of specially designed areas whose purpose is that mentioned above, namely to achieve a force of the least possible magnitude without hindering the perfect electrical contact and the ease of entry into the inside of the terminal of the male end, which should not be considered the same individually, since, as has been mentioned, the terminal is specially designed to be inserted in a connector box. In the conception of the referred terminal specially designed parts have been included to compensate for the axial pressure produced on the rear portion of the terminal when the male terminal is inserted, thus ensuring the reliability of the same despite its being connected and disconnected on multiple occasions.

BRIEF DESCRIPTION OF THE DRAWINGS

Other details and features of the present application will be revealed in the course of the description which is provided hereinafter; in which reference will be made to the drawings accompanying this Specification, in which, in a somewhat schematic manner, the preferred details are represented. These details are given by way of example, making reference to one embodiment, but is not limited to the details that are therein expounded; this description must therefore be considered from the illustrative point of view and without limitations of any kind whatsoever.

Following is a detailed list of the various elements which are mentioned in the present application: (10) terminal, (11) wings, (12) tabs, (13) ribs, (14) side walls, (15) side walls, (16) bore, (17) wings, (18) upper side wing, (19) lower side wing, (20) tab, (21) base of terminal, (22) inclined contacts, (23) semi-circular fold, (24) bore, (25) lengthwise groove, (26) upper view of terminal (10), (27) wing, (28) wing, and (29) stops.

DESCRIPTION OF THE PREFERRED EMBODIMENT

Figure 1:
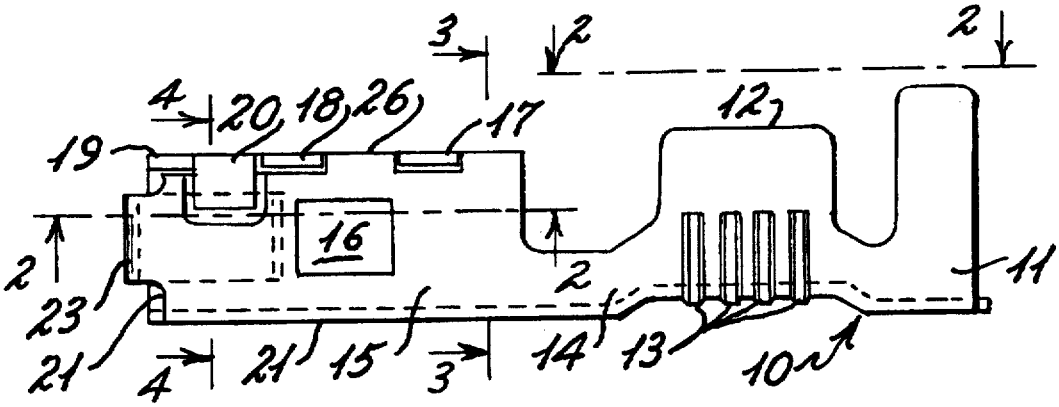
FIG. 1 is a side elevation view of the terminal (10) of the invention.

In one of the preferred embodiments of the object of the present application, such as can be seen in FIG. 1, the terminal (10) includes a considerably conventional anterior portion which is built on a considerably flat base (21), from which emerge wings (11) and tabs (12) perpendicular to (21), wings (11) and tabs (12) being connected through diverging side walls (14) with respect to the lengthwise axis of terminal (10).

The base of the terminal (21) presents in its anterior portion a bore (24) aligned with the tabs (12), and rigid ribbing (13), the purpose of the wings (11) and the tabs (12) being to bend in a converging direction over the conductor which is inserted between them, in order to trap it and achieve electrical contact with the end of the conductor.

Figure 3:
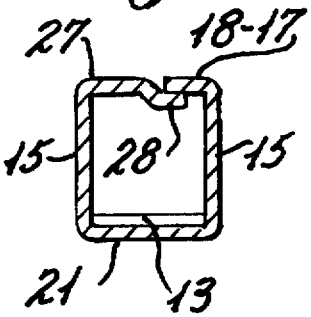
FIG. 3 is a 3—3 cross-section of FIG. 1.

The rear portion of the terminal (10) is configured in the form of a clip based on inclined contact planes (22) which are the extension of the side walls (15) converging on their free ends, while in the opposite areas or extremes they present a semi-circular fold (23). The side walls (15) are bent in their upper edges to form an area (27) in which a wing (17) extending from the side walls (15) can be found, in addition to an upper wing (18) which also extends from the side walls, as shown in FIG. 3.

Figure 4:
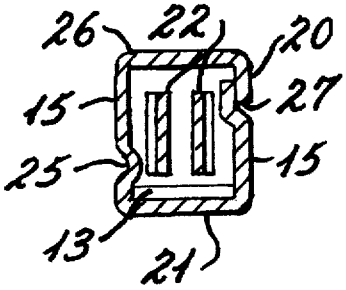
FIG. 4 is a 4—4 cross-section of FIG. 1.

As shown in FIG. 4, the cross-section of the terminal is considerably rectangular, having on one of the side walls (15) a lengthwise groove (25) whose function is to serve as a guide for fitting to a corresponding connector box, preventing the movement of the terminal (10) when inserting the male terminal in the inside of the flat contact areas (22).

As shown also in FIG. 4, one of the side walls (15) is bent inwards forming a 90° angle and hence an upper flat surface (26), whose end in turn is bent into a tab (20) fitting into a wing (27) extending from the opposite side wall (15).

In the middle area of the terminal (10), as shown in FIG. no. 3, a cross-section of the perimeter shows a considerably rectangular shape consisting of the flat base (21) from which the side walls (15) emerge in perpendicular fashion to (21), and whose ends are bent by wings (17–18) and (28) which overlap and confer great rigidness to the terminal (10) and in the configuration of a prismatic box without bases.

The overlapping of the upper wings (17–18) with the lower side wing (27) confer great rigidness to the terminal (10) and prevent lengthwise torque when inserting the male terminal into the inner part of the inclined contact planes (22).

In order to lock the terminal (10) in the event that it should be inserted into a connector box, a rectangular bore (16) has been provided on the side walls (15) of the terminal (10) in order to allow the insertion of the corresponding boss located in the inner walls of the connector box.

Figure 2:
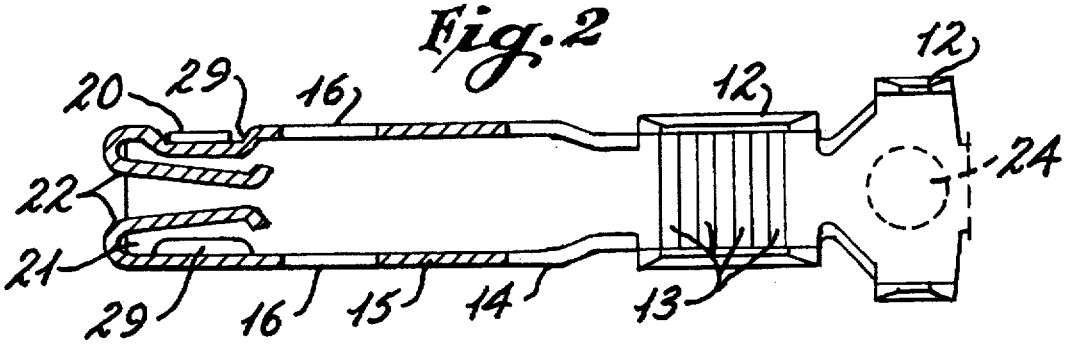
FIG. 2 is a lengthwise cross-section through 2—2 of FIG. 1.
Figure 5:
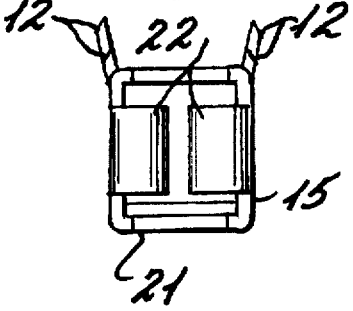
FIG. 5 is a front-rear elevation view of the terminal (10).

The rear portion of the terminal (10), as shown in FIG. 5, has a considerably rectangular configuration, rising from the flat base (21), out of which the walls (15) emerge perpendicularly, linking the wings (11) to the tabs (12) through the side walls (14), as can be seen in FIGS. 1 and 2.

The configuration of the terminal (10) in the form of a closed box responds, firstly, to the need to protect the surfaces (22) from external agents such as dust, humidity and the vertical fall of water, and in second place the configuration confers great rigidness to the terminal, the whole of which is reinforced by means of stops (29), one in the form of a tab on the side part of (10) and other being the wing (20) itself, which doubles as a stop, thus limiting the movement of the two contacts (22) not only against the insertion of the male terminal but also against vibrations from the automobile itself.

It shall be understood, after having looked at the drawings, and the explanations given of them, that the application, which has motivated the present specification, allows for an easy and effective manufacture which can be carried out very easily, constituting, without any doubt whatsoever, a new industrial achievement.

It is hereby stated, for those whom it may concern, that all of those variations and modifications of details which circumstances and practical application could warrant, can be introduced in the object of the present application, provided that any variations that might be introduced do not alter or modify the essence of that which is set forth in the followings claims.

I claim:

1. An electrical terminal connector for mounting in a connector box for selectively and frictionally receiving a male terminal of an electrical conductor, comprising, a base, first and second substantially planar spaced side walls extending upwardly from said base and having opposite first and second ends, a pair of contacts extending from said first end of said first and second side walls toward said second ends thereof so as to be intermediate said side walls and having free ends, said contacts being connected to said side walls so as to be yieldable with respect thereto and said free ends converging toward one another, said contacts being spaced so as to frictionally engage a male terminal therebetween, first wings extending upwardly from said first and second side walls adjacent said second ends thereof adapted to crimpingly engage an electrical conductor, and opposing stops extending inwardly of said planes of said first and second side walls and positioned between said planes of said first and second side walls and said contacts for engaging said contacts as said contacts are moved away from one another when a male terminal is inserted therebetween, whereby said stops act to limit expansion of said contacts toward said first and second walls, and contacts in secured frictional engagement with a male terminal inserted therebetween.

2. The electrical terminal connector of claim 1 including second wings extending from said first and second side walls adjacent said pair of contacts and being folded one over the other whereby said first and second side walls and said second wings and said base define a substantially rectangular housing in which said contacts extend.

3. The electrical terminal connector of claim 2 wherein one of said stops is formed by a groove in an exterior surface of said first side wall which groove urges a portion of said first side wall inwardly relative to one of said contacts.

4. The electrical terminal connector of claim 3 wherein a second stop is formed in said second side wall by having an upper portion of said second side wall indented toward an adjacent contact and a tab extending from said first side wall overlapping said indented upper portion of said second side wall.

5. The electrical terminal connector of claim 4 including a pair of aligned openings in each of said first and second side walls spaced intermediate said first and second ends thereof.

6. The electrical terminal connector of claim 5 including a separate pair of opposing tabs extending from each of said first and second side walls spaced between said first wings and said second end of said first and second side walls.

7. The electrical terminal connector of claim 1 wherein one of said stops is formed by a groove in an exterior surface of said first side wall which groove urges a portion of said first side wall inwardly relative to one of said contacts.

8. The electrical terminal connector of claim 7 wherein a second stop is formed in said second side wall by having an upper portion of said second side wall indented toward an adjacent contact and a tab extending from said first side wall overlapping said indented upper portion of said second side wall.

* * * * *